US010676955B1

(12) United States Patent
Tufto et al.

(10) Patent No.: US 10,676,955 B1
(45) Date of Patent: Jun. 9, 2020

(54) PORTABLE OUTDOOR ACTIVITY SHELTER WITH CONVERTIBLE FRAME

(71) Applicant: Innovative Outdoor Solutions, Inc., Maple Lake, MN (US)

(72) Inventors: Troy Tufto, Maple Lake, MN (US); Kevin Ziebarth, Maple Lake, MN (US)

(73) Assignee: Innovative Outdoor Solutions, Inc., Maple Lake, MN (US)

( * ) Notice: Subject to any disclaimer, the term of this patent is extended or adjusted under 35 U.S.C. 154(b) by 0 days.

(21) Appl. No.: 16/286,033

(22) Filed: Feb. 26, 2019

(51) Int. Cl.
*E04H 15/38* (2006.01)
*E04H 15/48* (2006.01)
*E04H 15/00* (2006.01)

(52) U.S. Cl.
CPC ..... *E04H 15/38* (2013.01); *E04H 15/001* (2013.01); *E04H 15/48* (2013.01)

(58) Field of Classification Search
CPC ..... E04H 15/38; E04H 15/001
See application file for complete search history.

(56) References Cited

U.S. PATENT DOCUMENTS 1,913,572 A * 6/1933 Thonet-Drechsel .... E04H 15/38 135/132
3,865,123 A * 2/1975 Bracken ..... E04H 15/38 135/132
5,271,423 A * 12/1993 Eychaner ..... E04H 15/001 135/134
5,368,057 A 11/1994 Lubkeman et al.
7,882,849 B2 2/2011 Franta
8,079,380 B2 * 12/2011 Engstrom ..... E04H 15/001 135/133
9,194,153 B2 * 11/2015 Makos ..... E04H 15/38
9,238,924 B2 * 1/2016 Wyant ..... E04H 15/001
9,394,718 B1 * 7/2016 Hill ..... E04H 15/001
10,058,181 B2 * 8/2018 Makos ..... A47C 1/14
2006/0238005 A1 * 10/2006 Walter ..... A01K 97/01 297/218.2
2010/0126546 A1 * 5/2010 Chen ..... E04H 15/38 135/126

* cited by examiner

*Primary Examiner* — Noah Chandler Hawk
(74) *Attorney, Agent, or Firm* — Dicke, Billig & Czaja, PLLC

(57) ABSTRACT

A portable outdoor activity shelter including a flexible cover and a frame. The frame including a plurality of sidewall poles convertible between a first configuration and a second configuration, when in the first configuration, the frame and flexible cover together moveable between a collapsed position and a deployed position. When in the deployed position, the frame to support the flexible cover to form a roof, opposed first and second sidewalls, and opposed front and rear walls, wherein at least one sidewall pole is moveable from a first position to a second position to convert the frame from the first configuration to the second configuration to provide access to a door in a corresponding one of the opposed first and second opposed sidewalls.

18 Claims, 12 Drawing Sheets

PORTABLE OUTDOOR ACTIVITY SHELTER WITH CONVERTIBLE FRAME

BACKGROUND

Portable outdoor activity shelters, such as hunting and ice fishing shelters, have become increasingly popular. Such shelters generally include a base to which a frame and flexible outer covering is attached, where the frame and covering can be extended from a collapsed or stowed position to a deployed position to form an enclosure.

SUMMARY

A portable outdoor activity shelter including a flexible cover and a frame. The frame including a plurality of sidewall poles convertible between a first configuration and a second configuration, when in the first configuration, the frame and flexible cover together moveable between a collapsed position and a deployed position. When in the deployed position, the frame to support the flexible cover to form a roof, opposed first and second sidewalls, and opposed front and rear walls, wherein at least one sidewall pole is moveable from a first position to a second position to convert the frame from the first configuration to the second configuration to provide access to a door in a corresponding one of the opposed first and second opposed sidewalls.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims. It is to be understood that the features of the various exemplary embodiments described herein may be combined with each other, unless specifically noted otherwise.

Figure 1A:
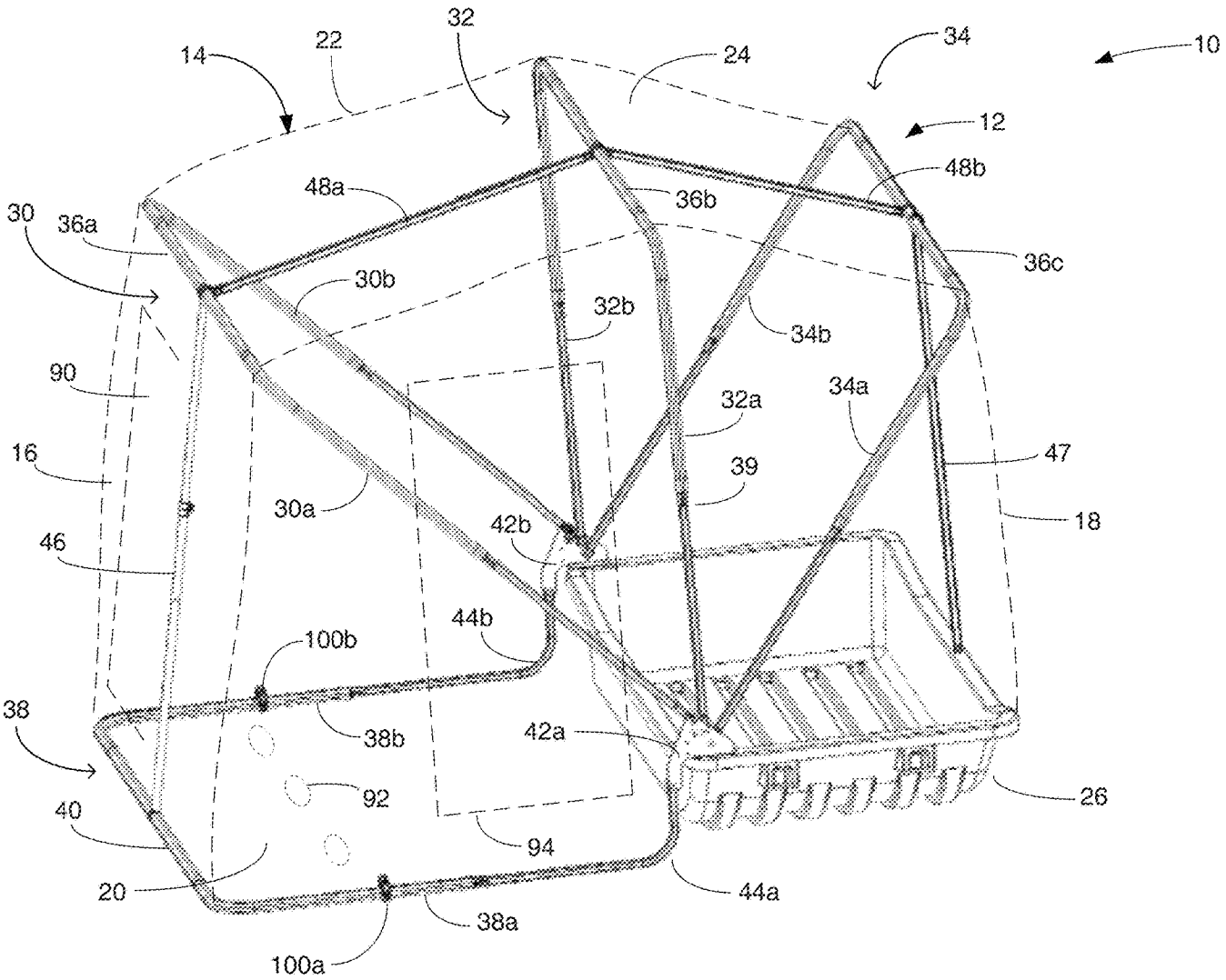
FIG. 1A is a perspective view generally illustrating a portable outdoor activity shelter in a deployed position, according to one example.
Figure 1B:
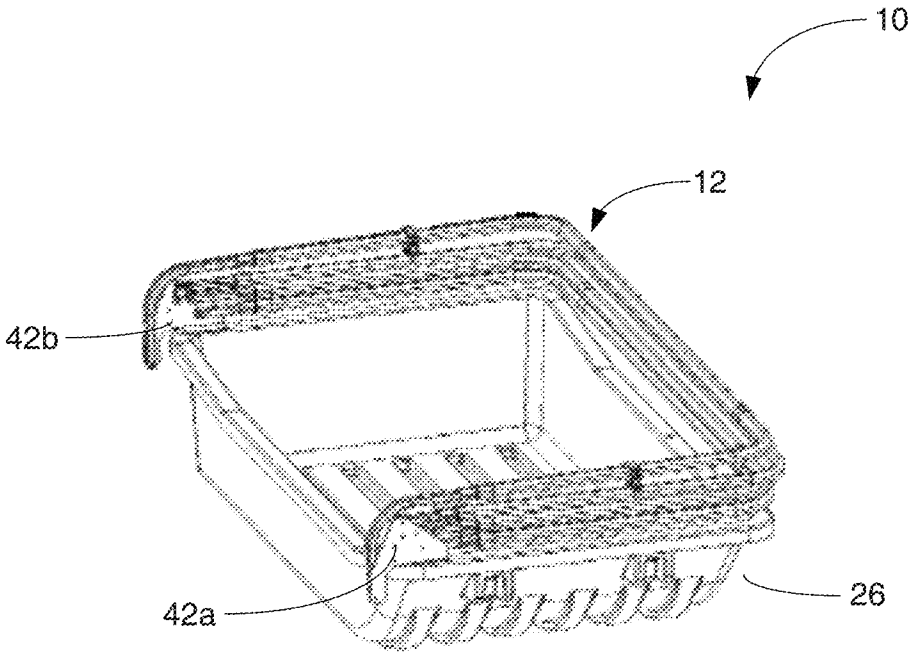
FIG. 1B is a perspective view generally illustrating a portable outdoor activity shelter in a collapsed position, according to one example.
Figure 2A:
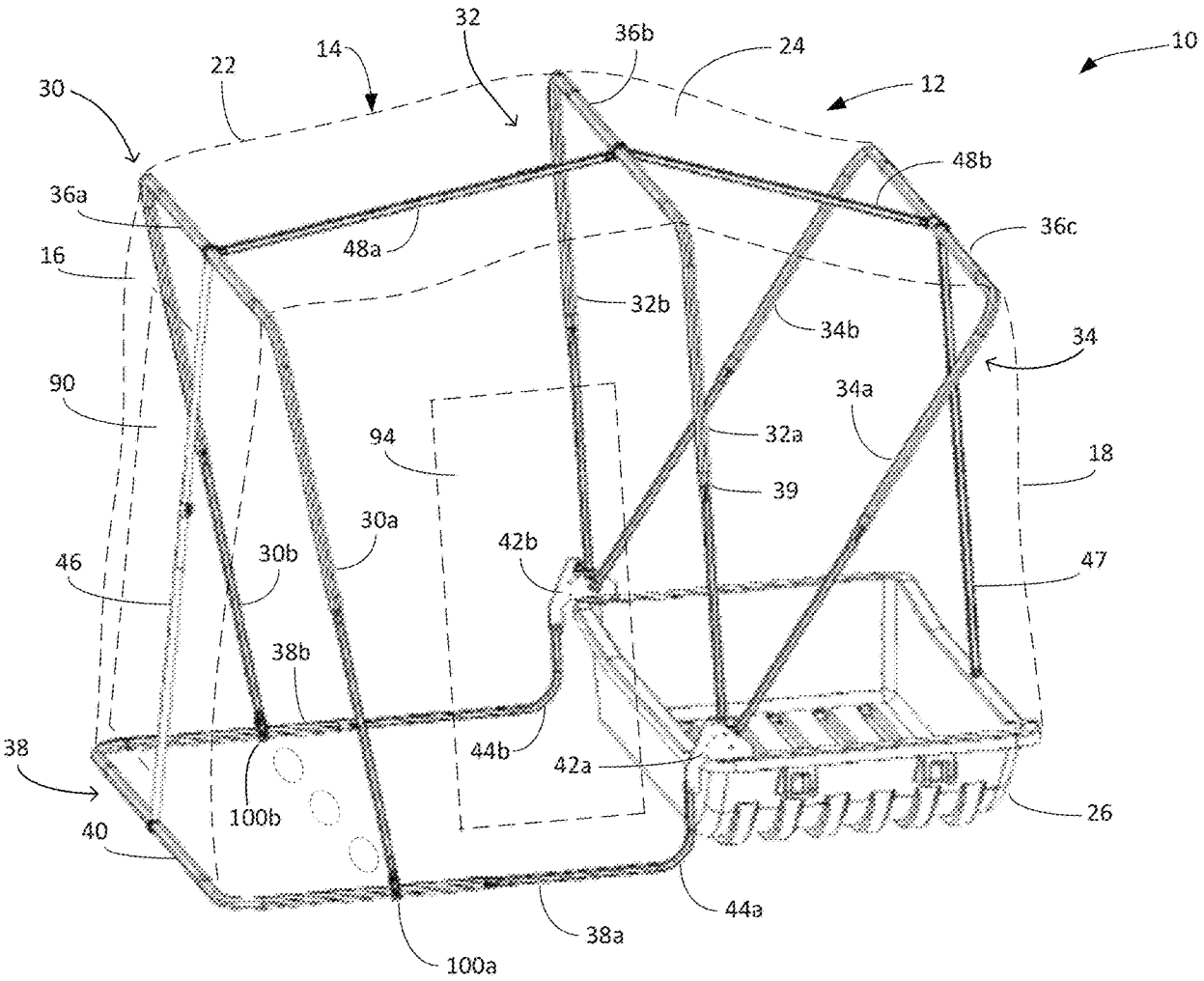
FIG. 2A is a perspective view generally illustrating a portable outdoor activity shelter in a side door configuration, according to one example.
Figure 2B:
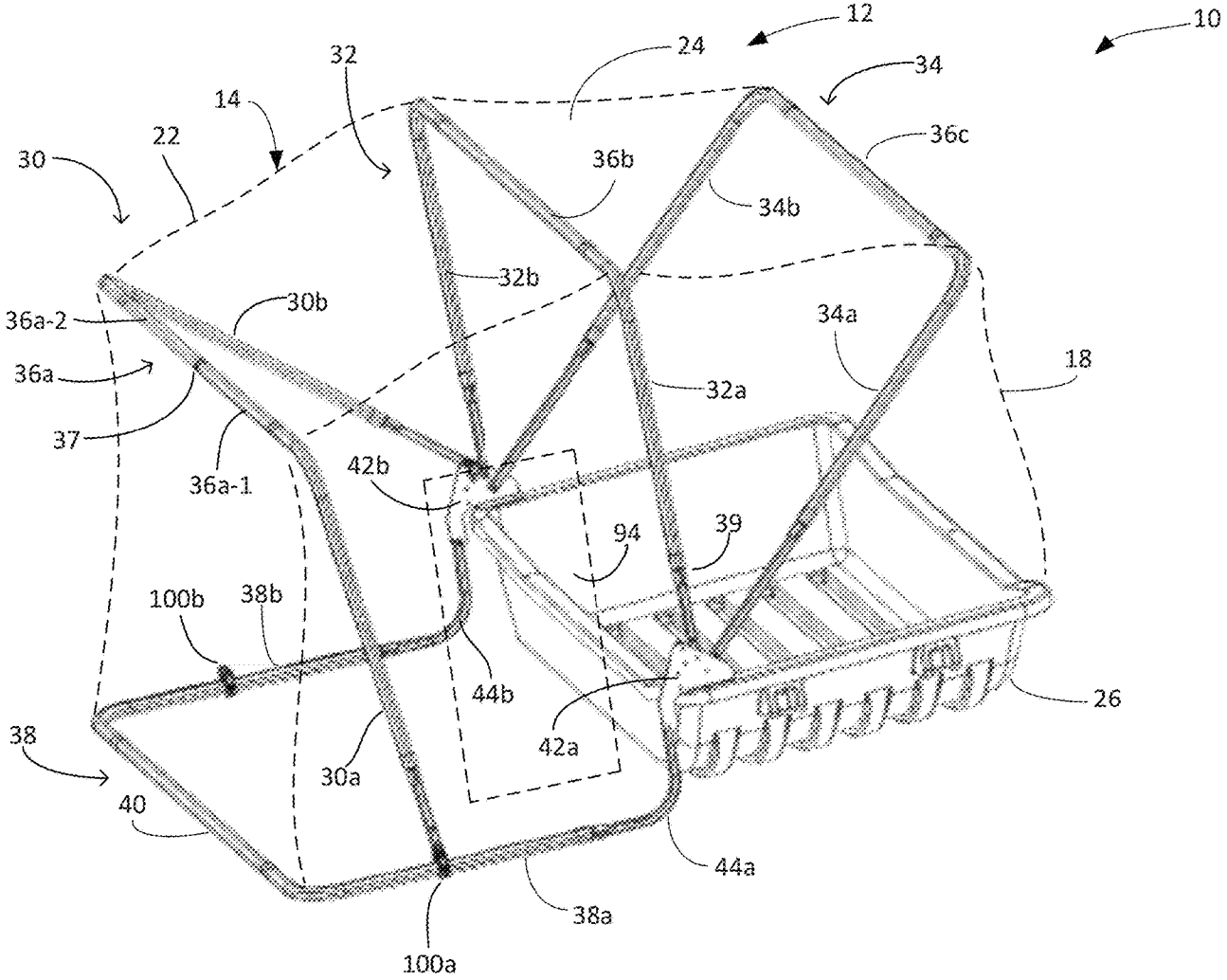
FIG. 2B is a perspective view generally illustrating a portable outdoor activity shelter in a side door configuration, according to one example.

FIG. 1A is a perspective view generally illustrating a portable outdoor activity shelter 10, such as an ice fishing house, for instance, according to one example of the present disclosure. Shelter 10 includes a frame 12 for supporting a flexible outer shell or cover 14, where frame 12 is convertible between a first configuration (also referred to as a crossover configuration), an example of which is illustrated by FIG. 1A, and a second configuration (also referred to as a side door configuration), examples of which are illustrated by FIGS. 2A and 2B below. When in the crossover configuration, frame 12 and flexible cover 14 are, together, moveable (can "crossover") between a collapsed position for transport and storage (see FIG. 1B) and a deployed position (such as illustrated by FIG. 1A).

According to one example, as illustrated by FIG. 1A, when in the deployed position, frame 12 supports flexible cover 14 to form a front wall 16, rear wall 18, first and second opposed sidewalls 20 and 22, and a roof 24 which define an interior space of shelter 10. It is noted that for ease of illustration of frame 12, cover 14 is shown as being transparent herein. In one example, shelter 10 includes a tub or sled 26 into/onto which frame 12 and cover 14 collapse and are stored when in the stowed or transport position (see FIG. 1B). In some examples, sled 26 may be adapted or accessorized to include a seat within shelter 10. As will be described in greater detail herein, when in the deployed position (such as illustrated by FIG. 1A), frame 12 is convertible between the first, or cross-over configuration, and the second, or side-door configuration (such as illustrated by FIGS. 2A and 2B) to enable access to door(s) in sidewalls 20 and/or 22, where such access would otherwise be blocked by elements of frame 12 when in the first configuration.

Returning to FIG. 1A, according to one example, frame 12 includes plurality of rib structures including a front rib structure 30, a center rib structure 32, a rear rib structure 34, and a base rib structure 38. Front rib structure 30 includes first and second front sidewall poles 30*a* and 30*b* connected at their upper ends by a spacer beam 36*a*, center rib structure 32 includes first and second center sidewall poles 32*a* and 32*b* connected at their upper ends by a spacer beam 36*b*, rear rib structure 34 includes first and second rear sidewall poles 34*a* and 34*b*, and base rib structure 38 includes first and second base sidewall poles 38*a* and 38*a* connected at one end by spacer beam 40. Together, rib structures 30, 32, 34, and 38 form a framework for supporting the root and sidewalls of shelter 10, with base rib structure 38 forming a base framework to anchor a lower portion of cover 14.

In one example, a pair bracket plates 42*a* and 42*b* are mounted to an upper edge of tub 26. As illustrated, lower ends of front, center, and rear sidewall poles 30*a*, 32*a*, and 34*a* are pivotally mounted to first bracket plate 42*a*, and lower ends of front, center, and rear sidewall poles 30*b*, 32*b*, and 34*b* are pivotally coupled to second bracket plate 42*b*. In one example, first and second base sidewall poles 38*a* and 38*b* respectively include drop down frame elements 44*a* and 44*b* via which first and second base sidewall poles 38*a* and 38*b* are respectively pivotally coupled to bracket plates 42*a* and 42*b*. In one example, as illustrated, sidewall poles 30*a*, 30*b*, 32*a*, 32*b*, 34*a*, and 34*b*, and base sidewall poles 38*a* and 38*b* are telescoping to enable their lengths to be adjusted when transitioning between the collapsed and deployed positions, with each having a set mechanism to maintain the poles at a desired length (e.g., a spring-loaded pin, set-screw, etc.), such as illustrated by telescoping set mechanism 39 of center sidewall pole 32*a*.

Figure 3:
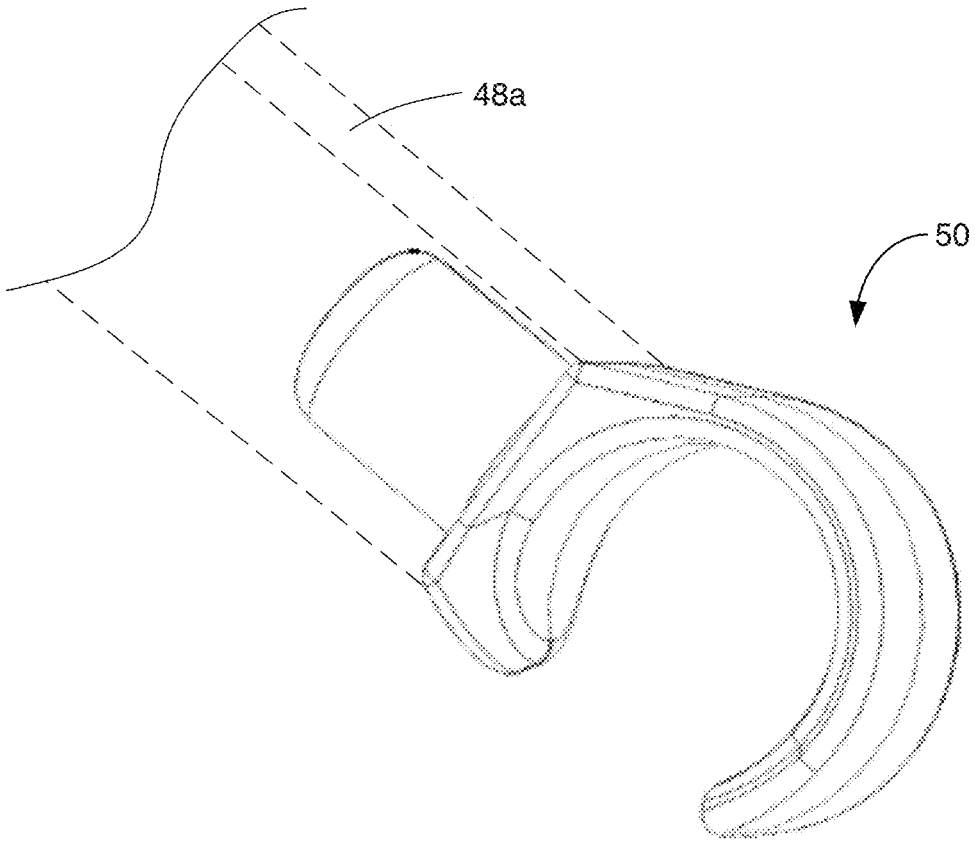
FIG. 3 is a perspective view generally illustrating a clamp suitable for use with a frame element of a portable outdoor activity shelter, according to one example.
Figure 4:
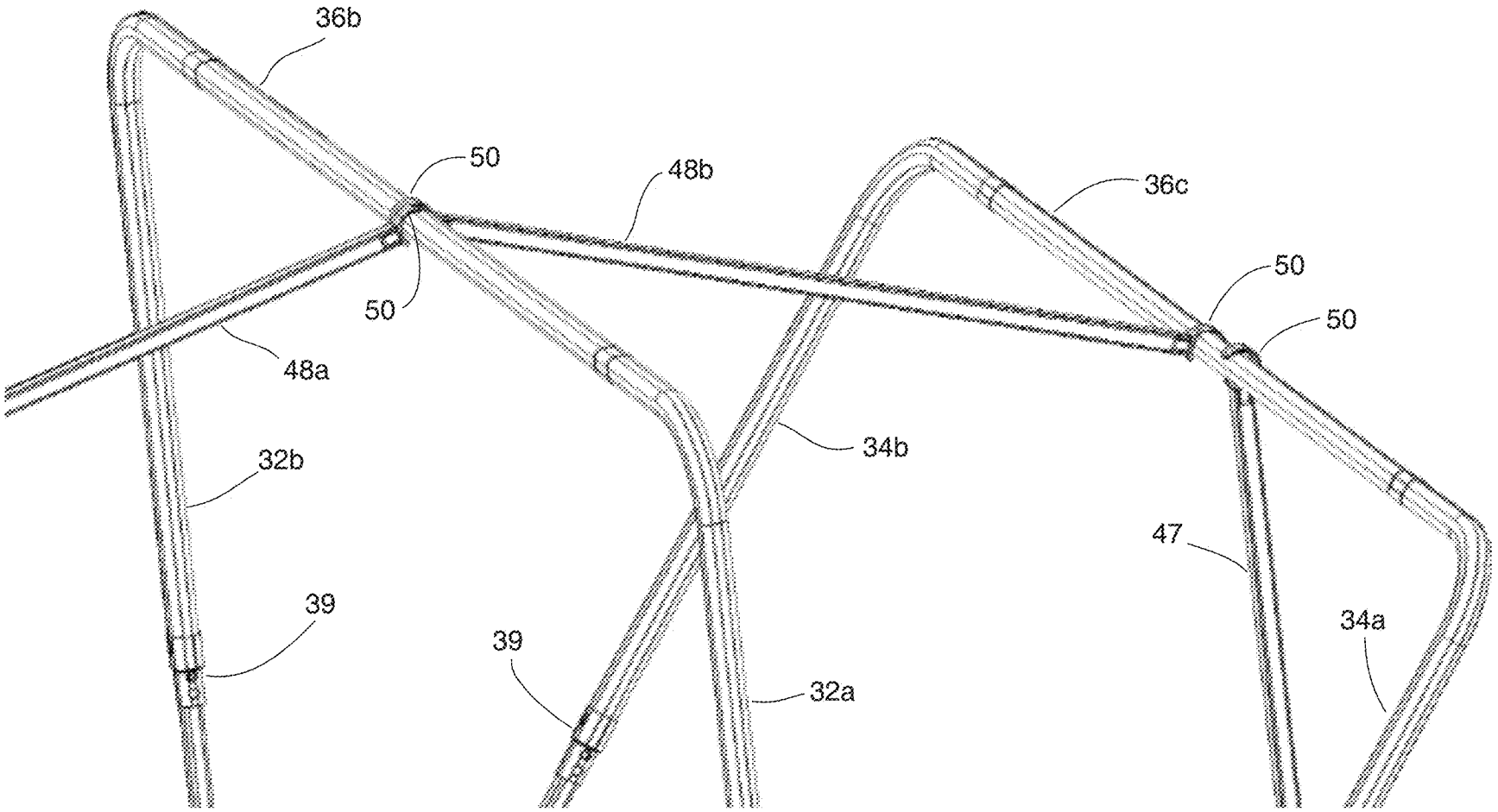
FIG. 4 is a perspective view generally illustrating a portion of a frame of a portable outdoor activity shelter, according to one example.

When in the deployed position, central spine elements may be installed to provide rigidity to frame 12. In one example, frame 12 includes a front spine element 46, a rear spine element 47, and center spine elements 48*a* and 48*b*, which interconnect spacer beams 36*a*-36*c* with one another and with spacer beam 40 and tub 26 to increase a rigidity to frame 12, such as to support to shelter 10 against wind, for example. In one example, the ends of spine elements 46, 47, 48*a*, and 48*a* include a clamp 50 for connecting the spine elements to the spacer beams. In one example, such as illustrated by FIG. 3, clamp 50 comprises a C-clamp 50, which is shown with respect to center spine element 48*a*. FIG. 4 is a perspective view illustrating center spine elements 48*a* and 48*b*, and rear spine element 47 being selectively coupled to spacer beams 36*b* and 36*c* via corresponding C-clamps 50. It is noted that other types of fastening mechanisms may be employed in lieu of C-clamps.

Figure 5:
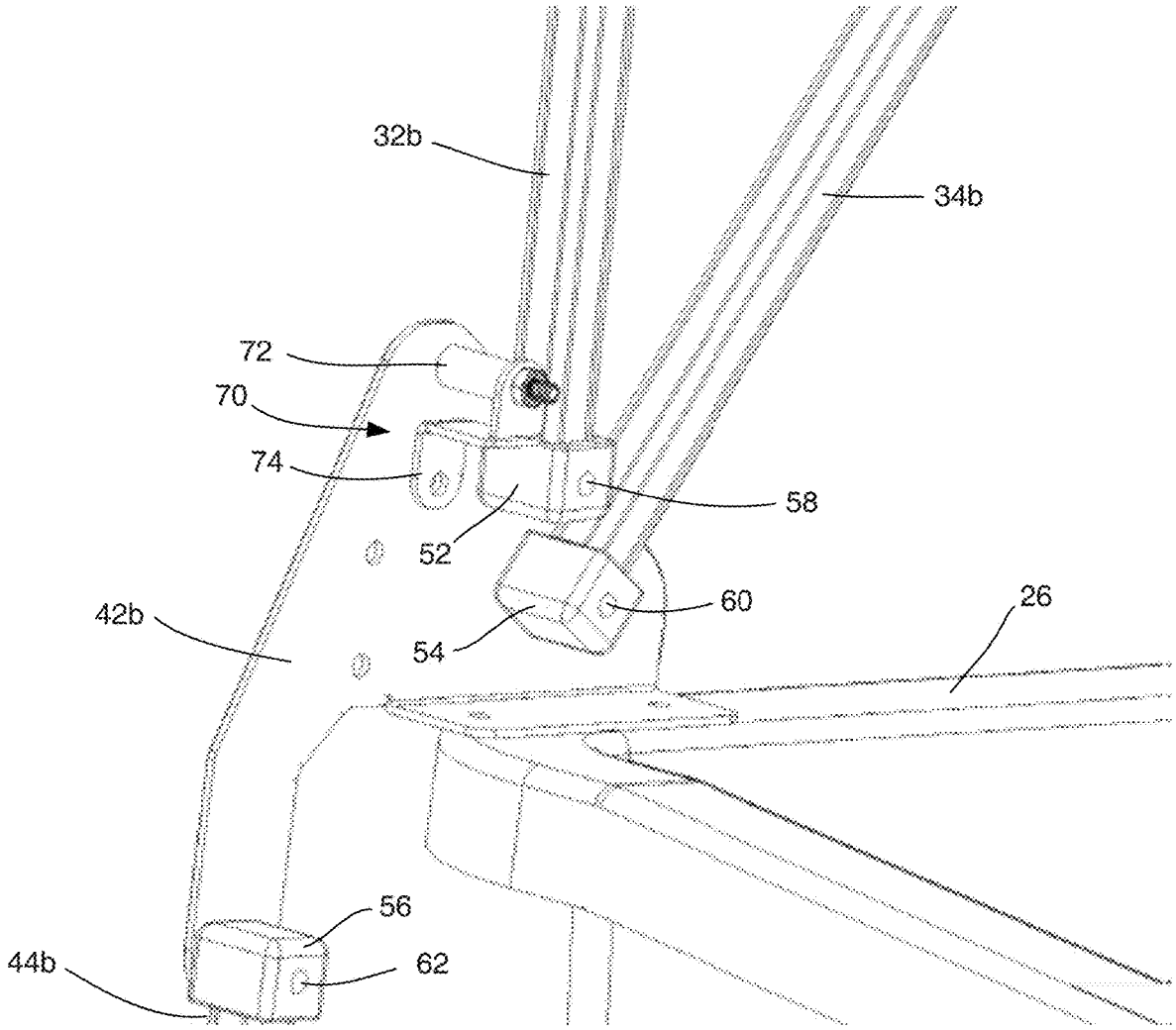
FIG. 5 is a perspective view generally illustrating a bracket plate for supporting portions of a frame of a portable outdoor activity shelter, according to one example.

FIG. 5 is a perspective view illustrating in greater detail an example of a bracket plate 42, which is illustrated with respect to bracket plate 42*b*. It is noted that bracket plate 42*a* is similarly configured. In one example, lower ends of center and rear sidewall poles 32*b* and 34*b*, and the upper end of drop down frame element 44*b* include corresponding spacer blocks 52, 54, and 56, which space the ends of center and rear sidewall poles 32*b* and 34*b* and drop down frame element 44*b* from bracket plate 42*b*. In one example, the lower ends of center and rear sidewall poles 32*b* and 34*b*, and the upper end of drop down frame element 44*b*, along with their corresponding spacer blocks 52, 54, and 56, are pivotally coupled to bracket plate 42*b* via corresponding pivot shafts 58, 60, and 62, so that center and rear sidewall poles 32*b* and 34*b* can rotate about pivot shafts 58 and 60, and base sidewall pole 38*b*, via drop down element 44*b*, can rotate about pivot shaft 62. In one example, pivot shafts 58, 60, and 62 comprise a retained pin type connection, such as clevis pin retained in place by a removable cotter pin, for example.

Figure 6:
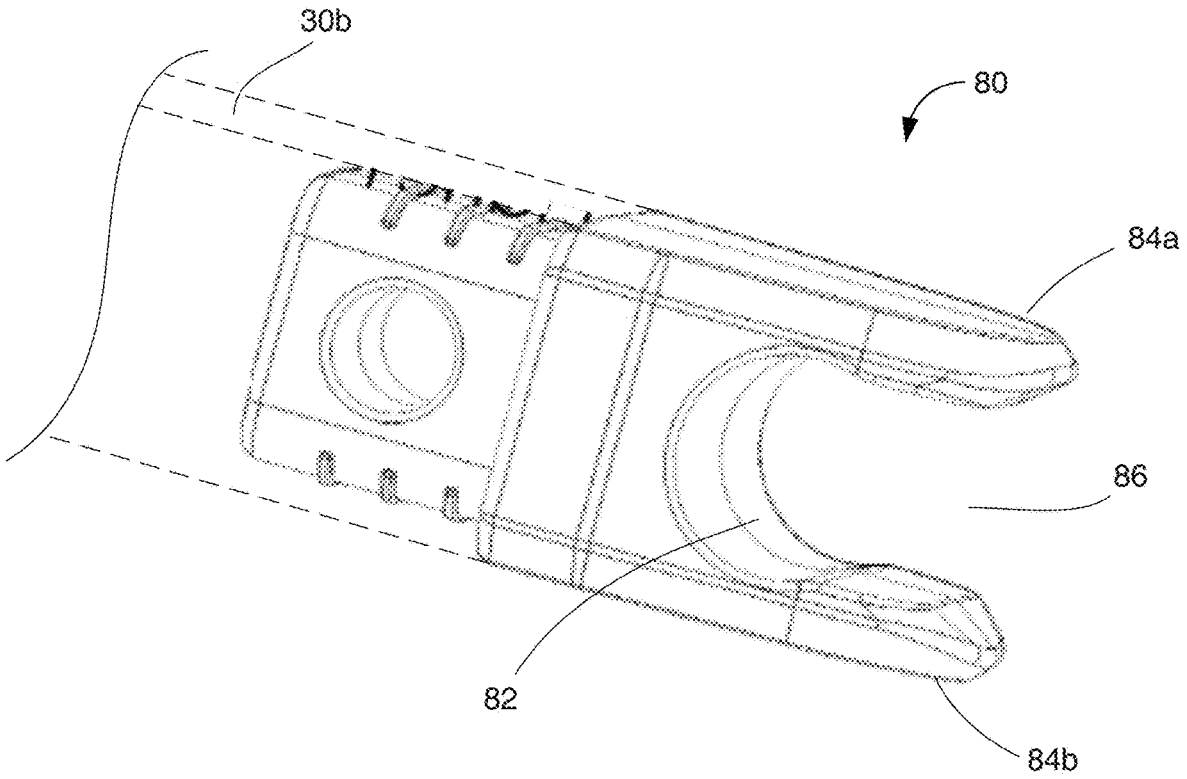
FIG. 6 is a perspective view generally illustrating a clamp suitable for use with a moveable frame element of a portable outdoor activity shelter, according to one example.
Figure 7:
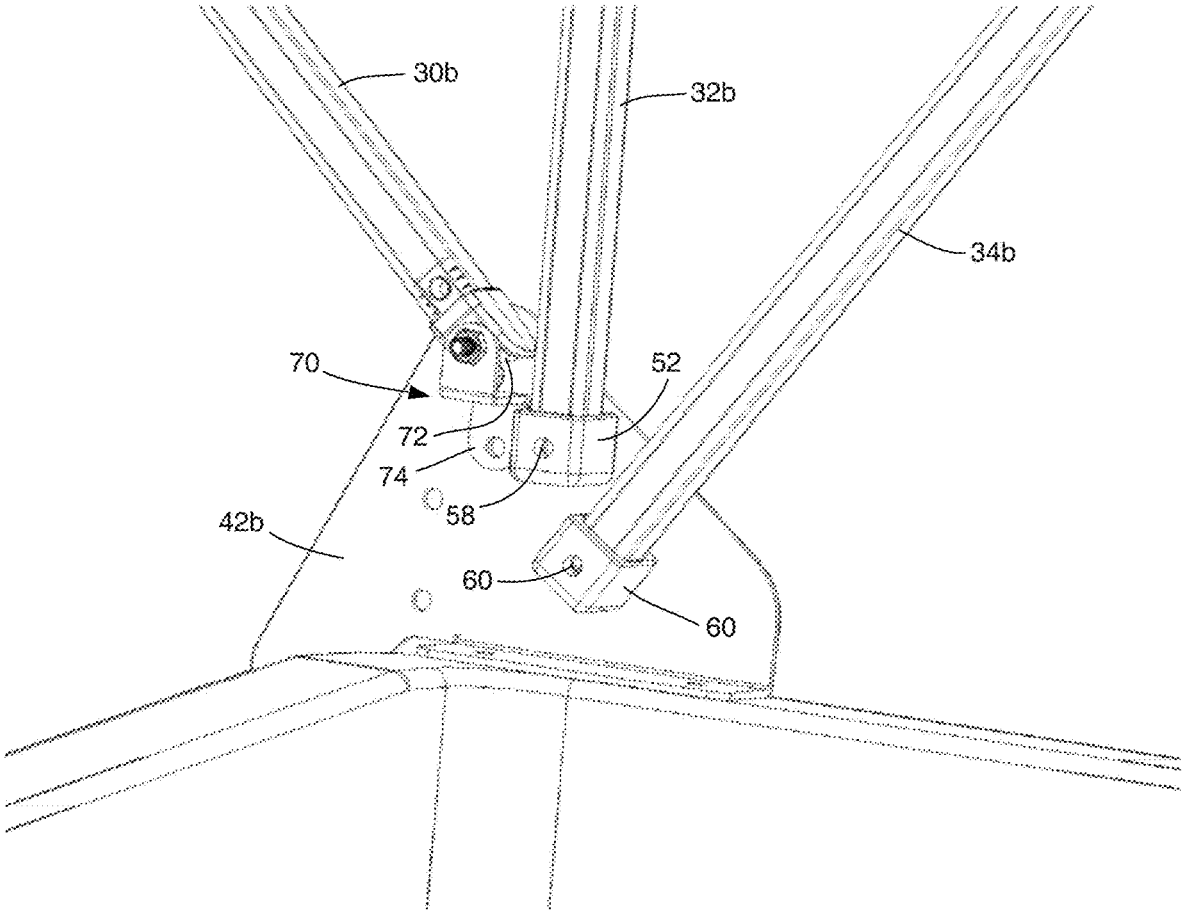
FIG. 7 is a perspective view generally illustrating a bracket plate for supporting portions of a frame of a portable outdoor activity shelter, according to one example.

In one example, bracket plate 42*b* includes an first quick switch bracket 70, where quick switch bracket 70 includes an upper quick switch bushing 72 connected to bracket plate 42*b* via a quick switch flange 74, where quick switch bracket 70 is to selectively connect to the lower end of front sidewall pole 30*b*. With reference to FIG. 6, according to one example, the lower end of front sidewall pole 30*b* includes a quick switch clip 80. In one example, quick switch clip 80 defines an opening 82 (e.g., a cylindrical opening) to receive upper quick switch bushing 72, and includes a pair of opposing elastic fingers 82*a* and 82*b* which are elastically biased toward one another to form a throat 86 which is narrower than opening 82. Throat 86 is configured to receive upper quick switch bushing 72, such that when quick switch clamp 80 is pushed onto upper quick switch bushing 72, bushing 72 is forced through elastic throat 86 and snaps into opening 82, thereby selectively securing the lower end of front sidewall pole 30*b* to upper quick switch bracket 70. FIG. 7 is a perspective view illustrating the lower end of front sidewall pole 30*b* in an installed position where the lower end of front sidewall pole 30*b* is secured to bushing 72 of first quick switch bracket 70 via quick switch clip 80.

Returning to FIG. 1A, cover 14 includes a door 90 (illustrated by dashed lines) positioned in front wall 16. In one example, door 90 comprises a zippered door opening in cover 14. Door 90 provides access to the interior of shelter 10, but, in some instances, such as when shelter 10 is being employed as an ice fishing shelter, holes 92 bored through the ice may be positioned between door 90 and sitting or standing areas toward rear wall 18, thereby making access via door 90 difficult. In such cases, alternate access to the interior of shelter 10 is desirable, such as via a side door 94 in cover 14.

In operation, according to one example, in order to transition shelter 10 between collapsed position and the deployed position, frame 12 must be in the cross-over position, as illustrated by FIG. 1A, where the ends of each pair of sidewall poles 30*a*/30*b*, 32*a*/32*b*, 34*a*/34*b* and the pair of base elements 38*a*/38*b* are pivotally coupled to first and second bracket plates 42*a*/42*b*. To transition to the stowed position from the deployed position of FIG. 1A, front spine element 46, rear spine element 47, and center spine elements 48*a* and 48*b* are de-coupled from corresponding elements of frame 12 (and placed inside tub 26 for storage, for example). After removal the spine elements, each pair of sidewall poles 34*a*/34*b*, 32*a*/32*b*, 30*a*/30*b*, and the pair of base elements 38*a*/38*b* (beginning with pair 34*a*/34*b* and ending with pair 38*a*/38*b*) are successively collapsed into themselves via release of the corresponding telescoping set mechanisms 39 and rotated about their pivots on bracket plates 42*a* and 42*b* and accumulated in an accordion-like fashion, along with cover 14 attached thereto, onto/into tub 26. The above process is carried out in reverse fashion to extend frame 12 and cover 14 from the stowed position to the cross-over position illustrated by FIG. 1A.

With reference to FIG. 1A, when shelter 10 is in the deployed position with frame 12 being in the cross-over position (where such position is required in order to move frame 12 between the collapsed or stored position and the deployed position, and vice-versa), front sidewall poles 30*a* and 30*b* respectively extend diagonally across sidewalls 20 and 22, thereby blocking access to sidewall access doors, such as side door(s) 94 on sidewalls 20 and/or 22. According to one example of the present disclosure, to provide access to side door(s) 94, one or both of the front pair of sidewall poles 30*a*/30*b* can be moved from their diagonally extending position to a more vertical position to convert frame 12 from the cross-over configuration of FIG. 1A to a side door configuration, such as illustrated by FIGS. 2A and 2B.

Figure 8:
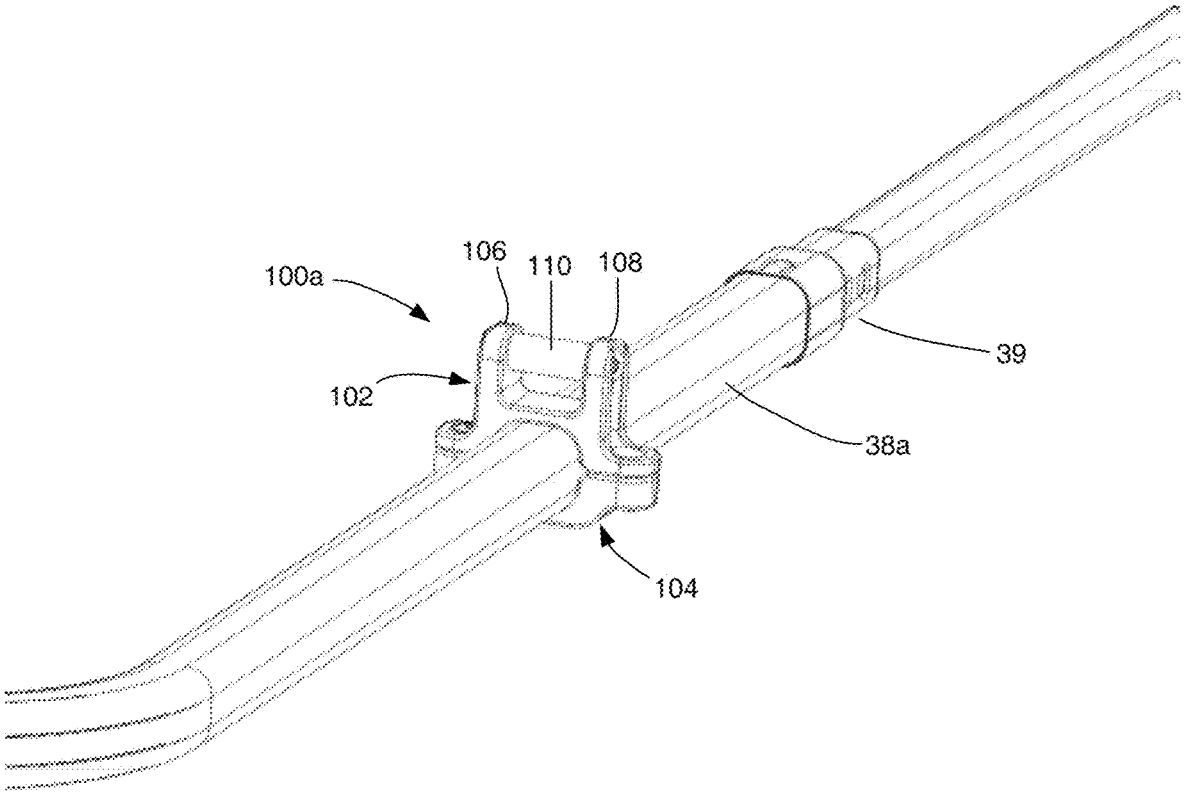
FIG. 8 is a perspective view generally illustrating a bracket for selectively securing a frame element of a portable outdoor activity shelter, according to one example.

In one example, base elements 38*a* and 38*b* respectively include quick switch brackets 100*a* and 100*b*. FIG. 8 is an enlarged perspective view illustrating quick switch bracket 100*a* on base element 38*a*, according to one example. As illustrated, similar to quick switch bracket 70 on bracket plates 42*a* and 42*b* (see FIG. 5), bracket 100*a* includes an upper element 102 and a lower element 104 coupled about base sidewall element 38*a*, with upper element 102 including two fingers 106 and 108 supporting a quick switch bushing 110.

With reference to FIG. 2A, according to one example, after extending frame 12 from a stowed position to the crossover position (see FIG. 1), to convert frame 12 from the cross-over to the side door configuration in order to gain access to sidewall door 94, the quick switch clips 80 on the lower ends of front sidewall poles 30*a* and 30*b* are removed from the corresponding upper quick switch bushing 72 on bracket plates 42*a* and 42*b* on tub 26. Front sidewall poles 30*a* and 30*b* are then rotated downward (clockwise in FIGS. 1A and 2) within a pivot formed by C-clamps 50 on center spine elements 46 and 48*a* (see FIG. 4), with the quick switch clips 80 on their lower ends being respectively clipped to quick switch bushings 110 on quick switch brackets 100*a* and 100*b*. The telescoping height of the front sidewall poles 30*a* and 30*b* is then adjusted and fixed at a desired length via corresponding set mechanisms 39. According to the side-door configuration of frame 12 as illustrated by FIG. 2, portable shelter 10 is accessible via side doors 94 and sidewalls 20 and/or 22.

To return shelter 10 to a stowed position from the side-door position, the lower ends of front sidewall poles 30*a* and 30*b* are decoupled from quick switch brackets 100*a* and 100*b* on base elements 38*a* and 38*b*, and returned to their respective positions on quick switch brackets 70 on bracket plates 42*a* and 42*b* so as to place frame 12 in the cross-over position. Once in the cross-over position, frame 12 and cover 14 may be collapsed into the stowed position on sled 26, as described above.

In one example, by employing clips 80 which are connectable to corresponding bushings on brackets 70 and 100 without the use of or need for retaining pins or other such fasteners, sidewall poles 30*a* and 30*b* can be readily moved between their first position (brackets 70) and second positions (brackets 100) to convert frame 12 between the cross-over and side door configurations.

In one example, when converting from the crossover position to the side door position, front sidewall poles 30*a* and 30*b* must both be moved from their respective quick switch brackets 70 on tub 26 to their corresponding quick switch brackets 100*a* and 100*b* on base elements 38*a* and 38*b*. In another example, front sidewall poles 30*a* and 30*b* may be moved between such positions independently of one another. For example with reference to FIG. 2B, a side door configuration is illustrated where only one of the front sidewall poles 30*a* and 30*b* is rotated from the crossover position to the side door position (in particular, front sidewall pole 30*a* of FIG. 2B). According to such configuration, access to shelter 10 may be via side door 94 in sidewall 20.

Figure 9:
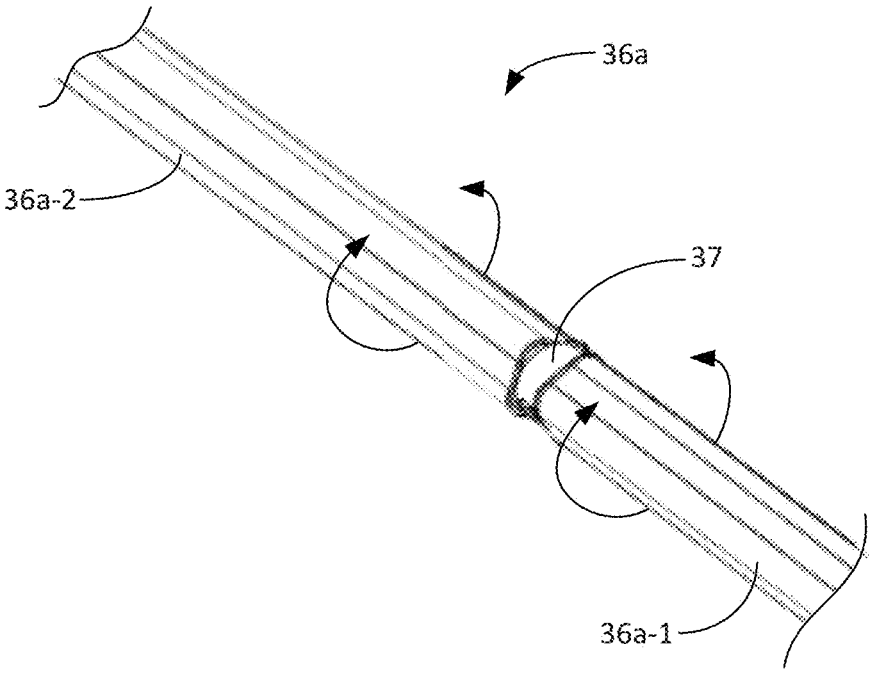
FIG. 9 is a perspective view illustrating a portion of a crossover beam frame element, according to one example.

With reference to FIG. 2B, according to one example to enable independent movement of front sidewall poles 30*a* and 30*b*, spacer beam 36*a* includes a rotating pivot 37 which enables a first end 36*a*-1 of spacer beam 36*a* to rotate independently from a second end 36*a*-2. FIG. 9 is an enlarged view of a portion of spacer beam 36*a*, according to one example, generally illustrating rotating pivot 37, where opposing first and second ends 36*a*-1 and 36*a*-2 of spacer beam may be independently rotated about pivot 37.

Figure 10A:
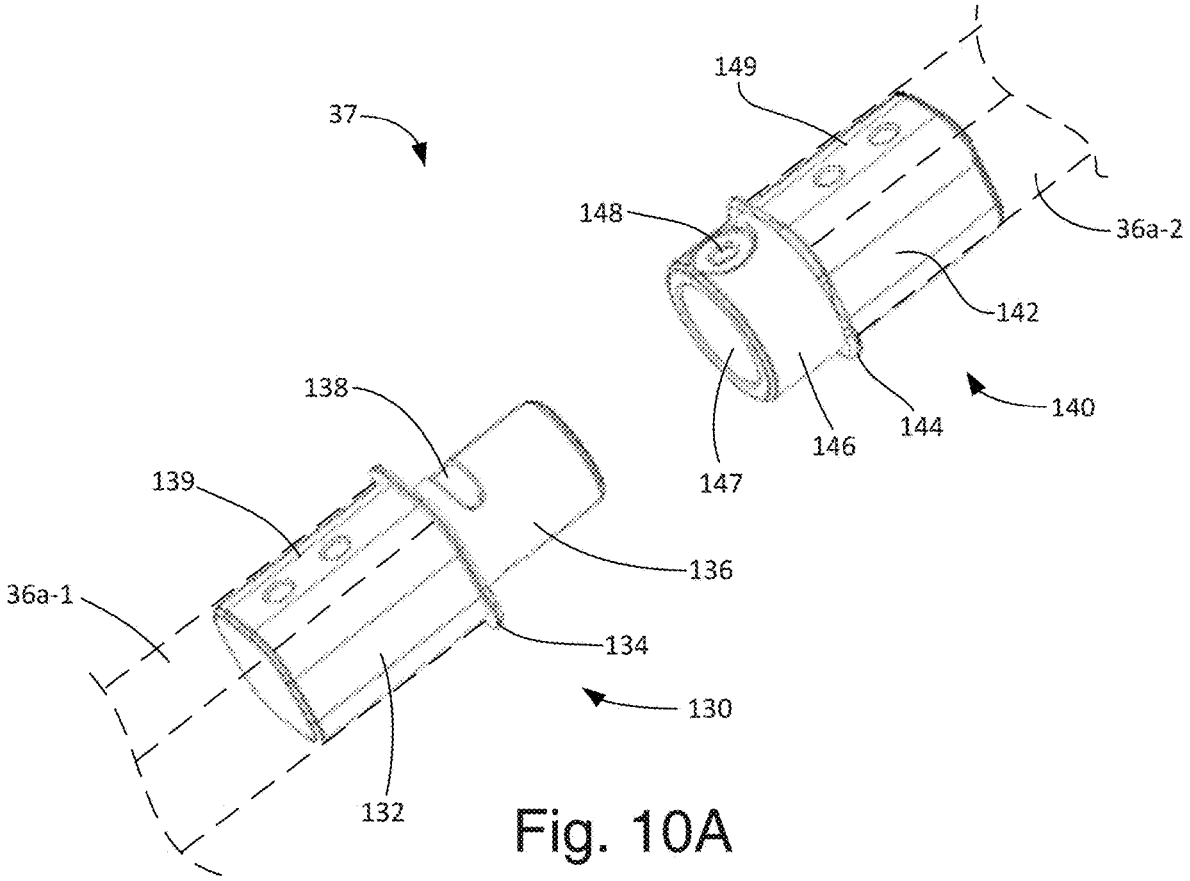
FIGS. 10A and 10B are perspective views illustrating a pivot mechanism, according to one example.
Figure 10B:
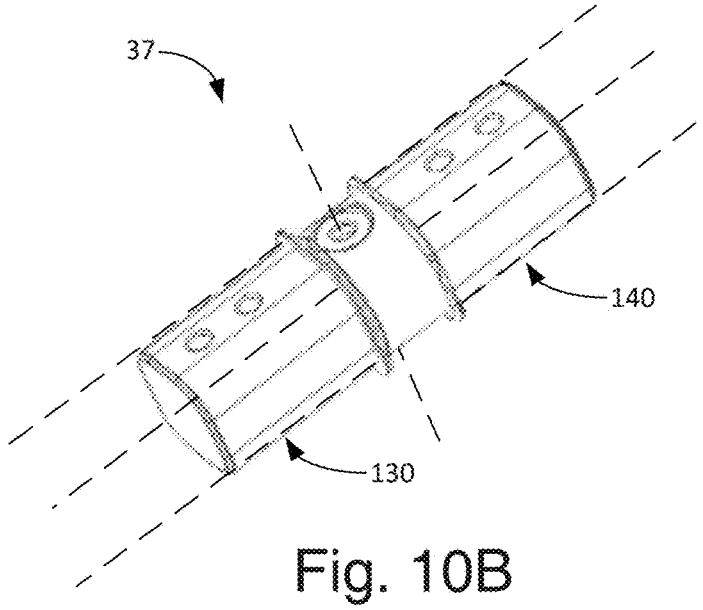

FIGS. 10A and 10B illustrate a pivot 37, according to one example of the present disclosure. It is noted that other types of pivot mechanisms may be employed. FIG. 10A is an exploded view, where pivot 37 includes an inner pivot element 130 and an outer pivot element 140. In one example, inner pivot element 130 includes a body 140, a shoulder flange 134, and a shaft 136 having a slot 138 extending there through. Body 132 slideably inserts into one end of spacer beam 36*a*, such as first end 36*a*-1, which abuts against shoulder flange 134 and is secured to body 132 via fasteners (not illustrated), such as rivets, for example, which insert into one or more openings 139 in body 132.

Outer pivot element 140 includes a body 142, a shoulder flange 144, and a shaft 146 having a shaft opening 147 to receive shaft 136 of inner pivot element 130. Shaft 147 further includes a pin opening 148 extending through opposite sides of the outer wall of shaft 147. Body 142 slideably inserts into the second end 36*a*-2 of spacer beam 36, which abuts against shoulder flange 144 and is secured thereto by fasteners via one or more opening 149. In one example, bodies 132 and 142 are rectangular in cross-section so as to fit into the rectangular cross-sections of first and second ends 36*a*-1 and 36*a*-2 of spacer beam 36*a*, where the rectangular shape prevents rotation of pivot elements 130 and 140 within first and second ends 36*a*-1 and 36*a*-2.

With reference to FIG. 10B, shaft 136 of inner pivot element 130 slideably inserts into shaft opening 147 and is rotated until slot 138 aligns with pin opening 148. A pin (not illustrated), or other fastener, is inserted so as to extend through pin opening 148 and slot 138 to couple inner pivot element 130 to outer pivot element 140. Slot 138 enables shaft 136 of inner pivot element 130 to be rotated within shaft opening 147 of output pivot element 140, with slot 138 defining an angle of rotation of shaft 136 within shaft opening 147. At a minimum, slot 138 enables rotation of front sidewall poles 30*a* and 30*b* from the crossover configuration of FIG. 1A to the side door configuration of FIGS. 2A and 2B.

Although illustrated as having three pairs of sidewall poles (i.e., 30*a*/30*b*, 32*a*/32*b*, and 34*a*/34*b*), in other examples, frame 12 may include more or fewer than three pairs of sidewall poles, where at least one of the sidewall poles of one or more of the pairs of sidewall polls may be moveable from a crossover position to a side door position.

By employing one or more sidewall poles that can be readily moved, without the use of tools or the removal of a pin, from one mounting bracket to another (e.g., from upper quick switch bracket 70 to lower quick switch bracket 100) to allow access to sidewall door 94, the versatility and functionality of shelter 10 is improved, while maintaining the ease of transitioning frame 12 and cover 14 between stowed and deployed positions.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A portable outdoor activity shelter comprising:

a flexible cover; and a frame including a plurality of sidewall poles convertible between a first configuration and a second configuration, when in the first configuration, the frame and flexible cover together being moveable between a collapsed position and a deployed position, when in the deployed position:

the frame to support the flexible cover to form a roof, opposed first and second sidewalls, and opposed front and rear walls, wherein at least one sidewall pole is moveable from a first position to a second position to convert the frame from the first configuration to the second configuration to provide access to a door in the one of the opposed first and second sidewalls corresponding to the at least one sidewall pole, the at least one sidewall pole extending across the door in the corresponding sidewall when in the first position and positioned beyond a perimeter of the door when in the second position.

2. The portable outdoor activity shelter of claim 1, the frame coupled to a transport tub.

3. The portable outdoor activity shelter of claim 1, the at least one sidewall pole including a clip to selectively clip to a first bracket when the frame is in the first configuration and to selectively clip to a second bracket when the frame is in the second configuration.

4. The portable outdoor activity shelter of claim 3, the at least one sidewall pole having the clip disposed at a lower end and being rotatable about an upper end opposite the lower end.

5. The portable outdoor activity shelter of claim 4, the clip comprising an elastic clip.

6. The portable outdoor activity shelter of claim 5, the clip comprising a pair of elastic fingers biased toward one another and forming throat to a shaft opening, the fingers to flex to expand the throat when a bushing of the first or second bracket is pushed through the throat to the shaft opening and, upon the bushing being seated in the shaft opening, the fingers to return to a non-flexed position where the throat is narrower than the shaft opening.

7. The portable outdoor activity shelter of claim 1, the frame including first and second base elements, the plurality of sidewall poles including a first group and a second group of sidewall poles, the first base element and first group of sidewall poles corresponding to the first sidewall, the second base element and second group of sidewall poles corresponding to the second sidewall, when the frame is in the first configuration, lower ends of the first base element and each of first group of sidewall poles pivotally connected to a first bracket plate, and lower ends of the second base element and each of the second plurality of sidewall poles pivotally connected to a second bracket plate, the at least one moveable sidewall pole being one of the first and second groups of sidewall poles with the corresponding pivotal connection characterized by the absence of captured pin connector.

8. The portable outdoor activity shelter of claim 7, the first and second base elements and first and second groups of sidewall poles to pivot about the corresponding bracket plates to extend the frame and cover between the collapsed and deployed position, the at least one moveable sidewall pole being one of the first and second groups of sidewall poles, when in the deployed position, the at least one moveable sidewall pole being moveable from a first bracket bushing on the corresponding one of the first and second bracket plates to a second bracket bushing on the corresponding base element to convert the frame from the first to the second configuration.

9. The portable outdoor activity shelter of claim 7, the first and second bracket plates mounted to a transport sled.

10. A portable outdoor activity shelter comprising:

a fabric cover;

a frame assembly comprising a plurality of frame elements, the frame assembly and fabric cover together moveable between a collapsed position and a deployed position, in the deployed position the frame to support the fabric cover to form a roof, opposed sidewalls, and opposed end walls to define an interior space of the shelter, when in the deployed position, at least one frame element moveable from a first support position to a second support position to provide access to a door to the interior space in one of the opposed sidewalls of the fabric cover, the at least one frame element to rotate at an upper end about a rotational axis perpendicular to the opposed side walls to move an opposing lower end from a first bracket in the first support position to a second bracket in the second support position.

11. The portable outdoor activity shelter of claim 10, the frame assembly and fabric cover moveable between the collapsed position and the deployed position when the at least one frame element is in the first support position.

12. The portable outdoor activity shelter of claim 10, the opposing lower end including an elastic clip to selectively couple to a first bracket in the first support position and to a second bracket in the second support position, the elastic clip characterized by the absence of a retaining pin.

13. The portable outdoor activity shelter of claim 10, the at least one frame element comprising a pair of frame elements each corresponding to a different one of the opposed sidewalls and joined at their upper ends by a spacer beam corresponding to the roof, the pair of frame elements and spacer beam rotatable about the axis of rotation, the axis of rotation being a longitudinal axis of the spacer beam, to rotate lower ends of the pair of frame elements from the first support position to the second support position.

14. The portable outdoor activity shelter of claim 10, the at least one frame element comprising a telescoping pole.

15. A portable shelter comprising:

a frame to support a flexible cover, the frame including a plurality of rib structures convertible between a first configuration and a second configuration, each rib structure including:

a first sidewall pole and a second sidewall pole each having an upper end and a lower end; and a spacer beam connected between the upper ends of the first and second sidewall poles;

when in the first configuration, each of the rib structures to rotate about the lower ends of the first and second sidewall poles to move the frame and flexible cover together between a collapsed position and a deployed position, when in the deployed position:

the frame to support the flexible cover to form a roof, opposed first and second sidewalls, and opposed front and rear walls, the first sidewall and second sidewall poles of each rib structure respectively corresponding to the first and second sidewalls, the lower end of at least one of the first and second sidewall poles of at least one rib structure to pivot between from a first position to a second position to convert the frame from the first configuration to the second configuration to provide access to a door in the corresponding sidewall.

16. The portable shelter of claim 15, the spacer beam of the at least one rib structure including a pivot mechanism bout which the spacer beam rotates to enable the lower end of the at least one of the first and second sidewall poles to pivot between the first position and the second position.

17. The portable shelter of claim 16, the lower ends of the first and second sidewall poles to independently pivot between corresponding first and second positions via independent rotation of opposing ends of the spacer beam via the pivot mechanism to provide access to doors in the first and second sidewalls.

18. The portable shelter of claim 17, further comprising:

a sled including a first bracket plate and a second bracket plate;

when in the first configuration:

the lower end of the first sidewall pole of each rib structure pivotally coupled to the first bracket plate; and the lower end of the second sidewall pole of each rib structure pivotally coupled to the first bracket; and when in the deployed position:

one of the rib structures rotated to a position to form a base structure; and the lower ends of the first and second sidewall poles of the at least one rib structures pivoted from the respective first and second bracket plates to respective brackets on the first and second sidewall poles of the base structure to convert the frame form the first configuration to the second configuration.

* * * * *